US005890809A

United States Patent [19]

Nelson

[11] Patent Number: 5,890,809

[45] Date of Patent: Apr. 6, 1999

[54] CARRYING BAG WITH DEPLOYABLE BOTTLE POUCH

[76] Inventor: Robert M. Nelson, 3255 Scott Rd., Burbank, Calif. 91504

[21] Appl. No.: 835,525

[22] Filed: Apr. 8, 1997

[51] Int. Cl.[6] ..... B65D 30/22

[52] U.S. Cl. ..... 383/40; 224/148.5; 224/581; 224/664

[58] Field of Search ..... 206/216; 383/37, 383/40; 224/148.5, 148.6, 581, 663, 664; 190/112, 113

[56] References Cited

U.S. PATENT DOCUMENTS

| | | | |
|---|---|---|---|
| 3,587,698 | 6/1971 | Ritter | 383/40 |
| 4,117,874 | 10/1978 | Berenguer | 383/28 |
| 4,404,687 | 9/1983 | Hager | 2/94 |
| 4,506,769 | 3/1985 | Franco et al. . | |
| 4,662,549 | 5/1987 | Dean . | |
| 4,782,874 | 11/1988 | Chartier | 150/112 |
| 5,152,612 | 10/1992 | Shoemaker | 383/40 |
| 5,158,220 | 10/1992 | Glass | 383/40 |
| 5,240,156 | 8/1993 | Sicotte et al. . | |
| 5,263,618 | 11/1993 | Talavera . | |
| 5,490,619 | 2/1996 | Boyar | 224/153 |
| 5,577,653 | 11/1996 | Bieker . | |

*Primary Examiner*—David T. Fidei
*Attorney, Agent, or Firm*—Kelly Bauersfeld Lowry & Kelley, LLP

[57] ABSTRACT

A carrying bag is provided of the type having at least one pocket for storing and carrying items, wherein the pocket contains a pull-out bottle pouch movable between a stored position concealed within the pocket and a deployed position for supporting and carrying a conventional sports water bottle or the like. The bottle pouch is constructed from a flexible material and is attached along one side edge to the bag at a location disposed inside the pocket. In the stored position, the pouch is collapsed to fit into the pocket. In the deployed position, the pouch is pulled to a position suspended outside the pocket to define an upwardly open bottle-receiving receptacle.

20 Claims, 3 Drawing Sheets

CARRYING BAG WITH DEPLOYABLE BOTTLE POUCH

BACKGROUND OF THE INVENTION

This invention relates generally to improvements in carrying bags such as belted "fanny" packs, backpacks, shoulder bags, and the like for personal use in storing and carrying a variety of items. More specifically, this invention relates to an improved and versatile bag equipped with a bottle pouch for supporting and carrying a water bottle or the like, wherein the bottle pouch is adapted for movement between stored and deployed positions.

Personal carrying bags are well known in the art and generally comprise a relatively compact and lightweight fabric-based bag structure defining at least one and typically multiple pockets or compartments for receiving and storing various articles. In one common form, the carrying bag comprises a so-called "belt" bag or "fanny" pack including a compact bag structure mounted on a belt and adapted to be worn about a person's waist, with the bag structure forming at least one and typically a plurality of zippered pockets. The bag structure is normally used to receive and store items such as a person's wallet, grooming aids, snack items, and the like. Belt bags of this general type are widely used in recreational and sports activities including jogging and hiking and the like.

Some belt bags are equipped with specialized compartments designed for supporting specific articles, for example, such as an upwardly open cylindrical receptacle for receiving and supporting a conventional sports water bottle or the like. Such specialized compartment beneficially adapts the belt bag for use in particular sports activities, but its presence increases the overall size and shape of the bag and thus may be undesirable when a person does not wish to carry a water bottle. To accommodate alternative uses, some bags have included detachable specialized compartments, such as a detachable water bottle holder adapted for quick and easy mounting onto the bag or belt therefor when a person desires to carry a water bottle. Unfortunately, detachable compartments such as water bottle holders and the like can be misplaced and lost when separated from the bag.

The present invention overcomes these problems and disadvantages by providing an improved carrying bag equipped with a bottle pouch designed for movement between a stored and concealed position when not in use, and a deployed position for supporting and carrying a water bottle or the like when use is desired.

SUMMARY OF THE INVENTION

In accordance with the invention, an improved carrying bag is provided of the type having at least one and preferably a plurality of compartments or pockets for storing and carrying items, wherein one of the pockets includes a bottle pouch adapted for movement between a stored position within the pocket and a deployed position disposed outside the pocket for supporting and carrying a water bottle or the like.

In the preferred form, the bag pockets include closure means such as zippers for selectively closing the pockets. The bottle pouch is formed from a flexible fabric material to define when deployed an upwardly open and generally cylindrical bottle-receiving receptacle. One upper side edge of the bottle pouch includes a mounting flap attached as by a sewn seam to the bag at a location inside an upper region of the associated pocket, such as along a seam formed generally adjacent to the pocket zipper. With this construction, the bottle pouch can be collapsed as by rolling upon itself to a compact shape suited to fit entirely within the pocket in the stored position, and to permit the pocket zipper to be closed. When pouch deployment is desired, the zipper can be opened and the pouch unfurled and pulled out to a location outside the pocket suspended from the attachment seam. In the deployed position, the bottle pouch is disposed to receive and support the water bottle or similar item.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
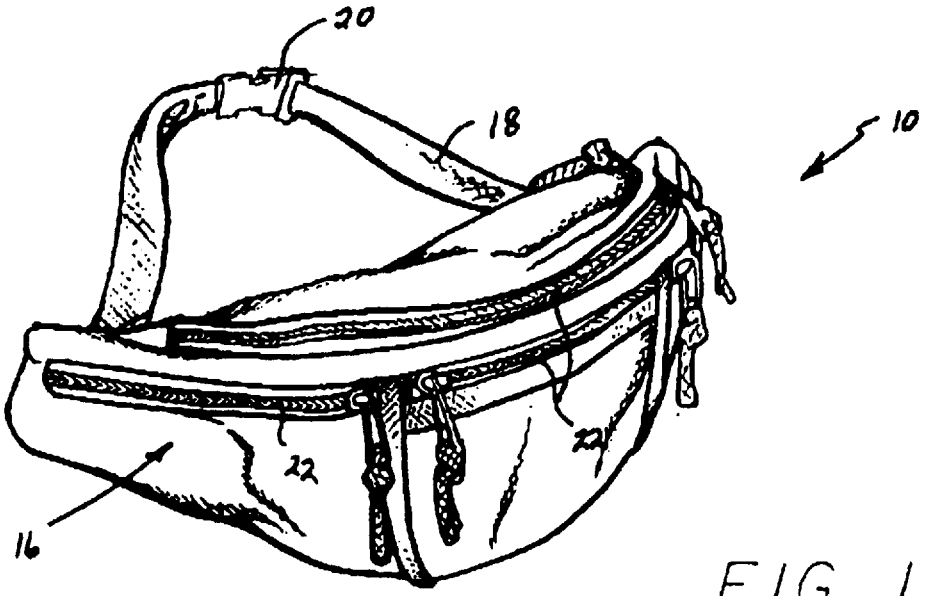
FIG. 1 is a perspective view illustrating a belt bag including a bottle pouch embodying the novel features of the invention, but showing the belt bag with the bottle pouch in a stored and concealed position.

As shown in the exemplary drawings, a bag referred to generally by the reference numeral 10 is provided with a bottle pouch 12 for supporting and carrying a water bottle 14 or the like. The bottle pouch 12 is designed for movement between a stored position (FIGS. 1 and 6) contained and concealed within a pocket 16 of the bag, and a deployed position (FIGS. 2–4) exposed to the exterior of the bag for use and carrying the water bottle 14, as desired by a person wearing or using the bag.

The bag 10 shown in the illustrative drawings is depicted in the form of a so-called belt bag or fanny pack, to include a bag structure of lightweight fabric or the like mounted on a belt 18 to permit the bag to be worn about a person's waist. A releasable buckle 20 is normally provided and accommodates belt size adjustment to fit the waist of a particular user. The bag structure conventionally includes at least one and typically a plurality of pockets equipped with individual closure means such as zippers 22 or the like. It will be understood, however, that the bag may take other known forms, such as a backpack or shoulder bag or the like. It will also be understood that alternative forms of pocket closure means may be used, such as flaps with Velcro type fasteners and the like.

In accordance with the invention, the bottle pouch 12 is mounted within a selected one of the bag pockets 16 for selective deployment or storage, as may be desired at any particular time by the person using the bag. The bottle pouch 12 is designed for quick and easy deployment and use to support and carry a conventional sports water bottle 14 or the like, thereby adapting the bag for uses wherein a person desires or requires a supply of water or other selected beverage. The pouch 12 is similarly designed for quick and easy storage within the associated pocket 16 in a concealed and essentially out-of-the-way position, thereby adapting the bag for alternative uses wherein a person does not desire or require the water bottle. The bottle pouch 12 remains securely attached to the bag at all times and thus cannot become separated and lost.

Figure 2:
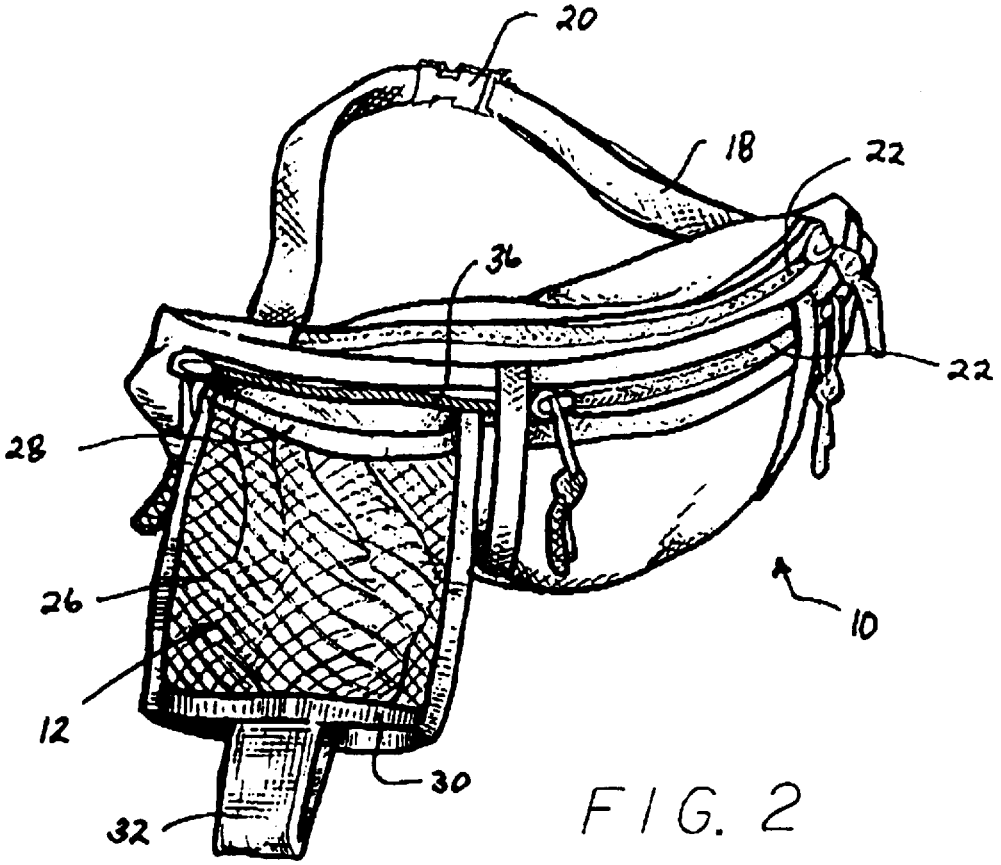
FIG. 2 is a perspective view of the belt bag of FIG. 1, but illustrating the belt bag with the bottle pouch in a deployed position.
Figure 3:
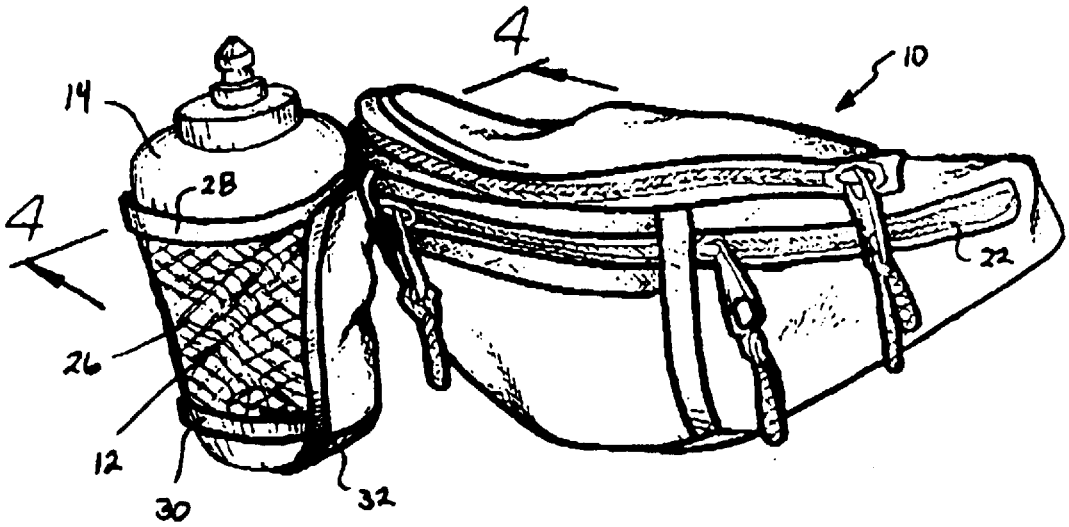
FIG. 3 is a further perspective view of the belt bag shown in FIG. 2, and depicting a water bottle supported by the bottle pouch.
Figure 4:
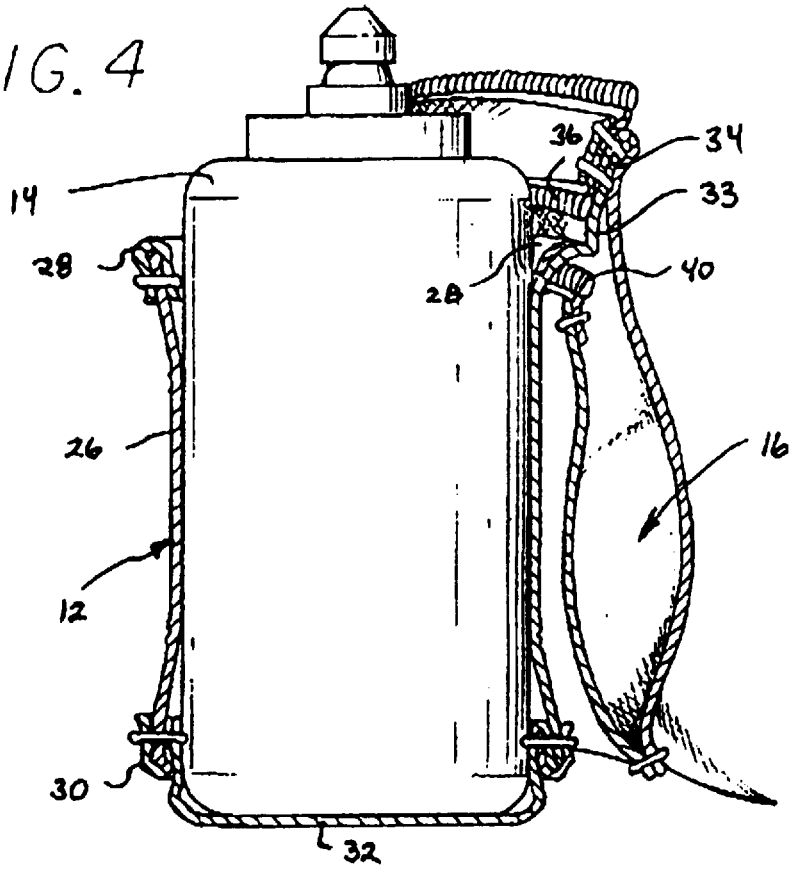
FIG. 4 is an enlarged fragmented vertical sectional view taken generally along the line 4—4 of FIG. 3.

As shown best in FIGS. 2–4, the bottle pouch 12 is constructed from lightweight and flexible fabric materials to facilitate movement between the stored and deployed positions. More particularly, the bottle pouch 12 comprises a generally cylindrical body 26 which may be constructed as shown from lightweight mesh fabric, with reinforcing straps 28 and 30 sewn thereto at the upper and lower ends thereof. The lower reinforcing strap 30 is also attached as by sewing to a lower base strap 32 which effectively closes the lower end of the body 26 sufficiently to support the lower end of a water bottle 14 positioned in the pouch 12. The upper reinforcing strap 28 and upper edge of the cylindrical body 26 are attached in turn to a short flap 33 (FIG. 4) along one side edge, wherein this flap 33 is secured in turn to the bag 10 by a sewn seam 34 at a location inside the associated pocket 16. As shown best in FIG. 4, a preferred location for the seam 34 is at an upper region of the pocket 16, such as by means of a common seam used also to attach an inboard zipper segment 36 of the pocket zipper 22. The mounting flap 33 extends along a portion, about one-fourth, of the circumference of the upper strap 28 and cylindrical body 26.

The flexible fabric bottle pouch 12 can thus be pulled out of the open or unzipped associated pocket 16 and unfurled to the deployed position as shown in FIGS. 2–4. In the deployed position, the pouch 12 defines an upwardly open and generally cylindrical receptacle having a size and shape for receiving and supporting the water bottle 24. The pouch 12 is suspended by the flap 33 at the exterior of the pocket 16, with the zipper 22 open. More specifically, the flap 33 extends beneath the inboard zipper segment 36 and over the associated outboard zipper segment 40 to position the pouch 12 at the outside of the pocket 16.

Figure 5:
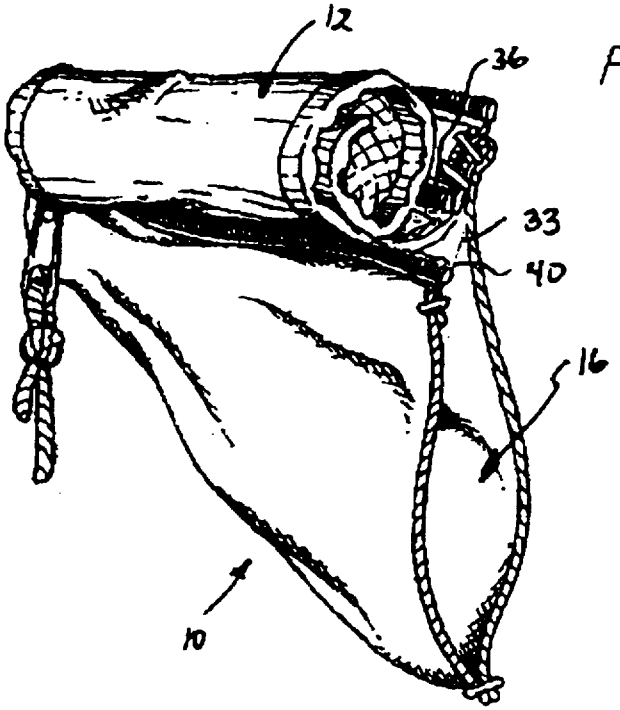
FIG. 5 is a fragmented perspective view, shown partially in vertical section, and showing the bottle pouch in a rolled up or collapsed configuration for movement from the deployed position to the stored position.
Figure 6:
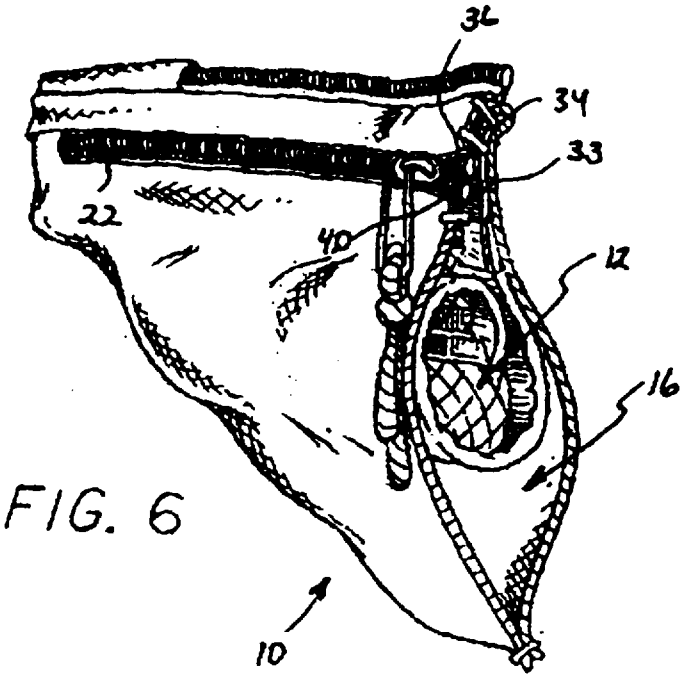
FIG. 6 is a fragmented perspective view similar to FIG. 5 to illustrate the bottle pouch in the stored and concealed position.

When use of the bottle pouch 12 is not desired, the pouch can be collapsed upon itself and stored compactly within the pocket 16. That is, as shown in FIGS. 5 and 6, the flexible fabric pouch material can be flattened out to a generally planar shape upon removal of the bottle 14, and then rolled upon itself (FIG. 5) to a small cylindrical shape for compact placement directly into the interior of the pocket 16. In this stored position, the pocket zipper 22 can be closed to conceal the bottle pouch 12, while leaving the majority of the pocket interior available for storing and carrying other items.

The improved bag 10 of the present invention thus provides a versatile yet relatively simple bag geometry adapted for alternative uses with or without a sports-type water bottle, according to the individual requirements of a person using the bag. The bottle pouch 12 can be stored or deployed quickly and easily, without requiring assembly or disassembly of the pouch from the remainder of the bag.

A variety of further modifications and improvements in and to the bag of the present invention will be apparent to those persons skilled in the art. Accordingly, no limitation on the invention is intended by way of the foregoing description and accompanying drawings, except as set forth in the appended claims.

What is claimed is:

1. A bag, comprising: a bag structure defining at least one pocket; closure means for selectively opening and closing said pocket; a bottle pouch; and means for connecting said bottle pouch to said bag structure at a location disposed inside said pocket, said bottle pouch being movable between a stored position contained within said pocket and a deployed position disposed substantially outside said pocket for receiving and supporting a water bottle when the pocket is open wherein said water bottle inside said bottle pouch is at least partially supported by and positioned against said bag structure.

2. The bag of claim 1 wherein said bottle pouch is formed from a flexible fabric material.

3. The bag of claim 1 wherein said closure means comprises a zipper.

4. The bag of claim 3 wherein said means for connecting comprises a flap connected to said bottle pouch and connected to said bag structure generally adjacent to said zipper.

5. The bag of claim 4 wherein said zipper includes an inboard segment and an outboard segment, said inboard segment of said zipper being attached to said bag structure by a seam, said flap being attached to said bag structure by said seam.

6. The bag of claim 1 wherein said bottle pouch has a generally cylindrical and upwardly open configuration in the deployed position, said connecting means connecting said bottle pouch generally at an upper end thereof to said bag structure.

7. The bag of claim 1 wherein said bag structure defines a plurality of pockets, said bottle pouch being connected by said connecting means to said bag structure within a selected one of said pockets.

8. The bag of claim 1 wherein said bottle pouch is formed from a fabric material collapsible to a generally planar state for compact storage within said pocket in the stored position, and for unfurling to an upwardly open generally cylindrical shape in the deployed position.

9. A bag, comprising: a bag structure defining at least one pocket; a bottle pouch; and means for connecting said bottle pouch to said bag structure at a location disposed inside said pocket, said bottle pouch being movable between a stored position contained within said pocket and a deployed position disposed substantially outside said pocket for receiving and supporting a water bottle, wherein said water bottle inside said bottle pouch is at least partially supported by and positioned against said bag structure.

10. The bag of claim 9 wherein said bottle pouch is formed from a flexible material to collapse to a generally planar shape for compact storage within said pocket in said stored position, and for unfurling to an upwardly open generally cylindrical shape in said deployed position.

11. The bag of claim 9 further including closure means for selectively closing said pocket when said bottle pouch is in the stored position.

12. The bag of claim 11 wherein said closure means comprises a zipper.

13. The bag of claim 9 wherein said means for connecting connects said bottle pouch generally at an upper end thereof to said bag structure.

14. A bag, comprising: a bag structure defining a plurality of pockets; a bottle pouch; and means for connecting said bottle pouch to said bag structure at a location disposed inside a selected one of said pockets, said bottle pouch being movable between a stored position contained within said pocket and a deployed position disposed substantially outside said pocket for receiving and supporting a water bottle, wherein said water bottle inside said bottle pouch is at least partially supported by and positioned against said bag structure.

15. The bag of claim 14 wherein said bottle pouch is formed from a flexible material to collapse to a generally planar shape and to permit said bottle pouch to be rolled upon itself for compact storage within said selected pocket in said stored position, and for unfurling to an upwardly open generally cylindrical shape in said deployed position.

16. The bag of claim 14 further including closure means for selectively closing said selected pocket when said bottle pouch is in the stored position.

17. The bag of claim 16 wherein said closure means comprises a zipper.

18. The bag of claim 17 wherein said means for connecting comprises a flap connected to said bottle pouch and connected to said bag structure generally adjacent to said zipper.

19. The bag of claim 18 wherein flap is connected to said bottle pouch generally at an upper end thereof.

20. A bag, comprising: a bag structure defining at least one pocket; closure means for selectively opening and closing said pocket; a bottle pouch; and means for connecting said bottle pouch to said bag structure at a location disposed inside said pocket, said closure means including an inboard segment and an outboard segment, said inboard segment of said closure means being attached to said bag structure by a seam, said means for connecting being attached to said bag structure by said seam, said bottle pouch being movable between a stored position contained within said pocket and a deployed position disposed substantially outside said pocket for receiving and supporting a water bottle when the pocket is open.

* * * * *